US008853539B2

(12) United States Patent
Ye et al.

(10) Patent No.: US 8,853,539 B2
(45) Date of Patent: Oct. 7, 2014

(54) CABLE WITH CURRENT LEAKAGE DETECTION FUNCTION

(75) Inventors: Xiangfa Ye, Zhejiang (CN); Yong Dai, Zhejiang (CN); Xiaoyong Li, Zhejiang (CN)

(73) Assignee: Heng Chen, Shanghai (CN)

( * ) Notice: Subject to any disclaimer, the term of this patent is extended or adjusted under 35 U.S.C. 154(b) by 775 days.

(21) Appl. No.: 12/753,266

(22) Filed: Apr. 2, 2010

(65) Prior Publication Data

US 2011/0061892 A1 Mar. 17, 2011

(30) Foreign Application Priority Data

Sep. 11, 2009 (CN) ..... 2009 1 0170347
Sep. 11, 2009 (CN) ..... 2009 1 0170348

(51) Int. Cl.
*H01B 11/06* (2006.01)
*H01B 7/32* (2006.01)

(52) U.S. Cl.
CPC ..... *H01B 7/328* (2013.01)
USPC ..... 174/106 R; 174/113 R

(58) Field of Classification Search
CPC ..... H01B 9/02; H01B 9/021
USPC ..... 174/106 R, 113 R
See application file for complete search history.

(56) References Cited

U.S. PATENT DOCUMENTS

| | | | | | |
|---|---|---|---|---|---|
| 3,355,544 | A | * | 11/1967 | Costley et al. | 174/106 R |
| 4,187,391 | A | * | 2/1980 | Voser | 174/106 R |
| 4,472,597 | A | * | 9/1984 | Uematsu | 174/106 SC |
| 4,486,252 | A | * | 12/1984 | Lloyd | 156/51 |
| 4,725,693 | A | * | 2/1988 | Hirsch | 174/107 |
| 4,965,412 | A | * | 10/1990 | Lai et al. | 174/107 |
| 5,171,938 | A | * | 12/1992 | Katsumata et al. | 174/36 |
| 2003/0168242 | A1 | * | 9/2003 | Whidden | 174/113 R |
| 2008/0099227 | A1 | * | 5/2008 | Zhang et al. | 174/113 R |
| 2008/0099239 | A1 | * | 5/2008 | Fong et al. | 174/391 |

FOREIGN PATENT DOCUMENTS

| | | | |
|---|---|---|---|
| CN | 2824239 | Y | 10/2006 |
| CN | 201066598 | Y | 5/2008 |
| CN | 201111991 | Y | 9/2008 |
| JP | 2002-343143 | * | 11/2002 |

* cited by examiner

*Primary Examiner* — Chau N Nguyen
(74) *Attorney, Agent, or Firm* — The PL Law Group, PLLC

(57) ABSTRACT

A cable having a current leakage detection function includes three current-carrying core wires. Each current-carrying core wire is wrapped by an insulating layer, so that the current-carrying core wires are electrically insulated from one another. The insulating layer of at least one of the current-carrying core wires is wrapped by a metal wire net. Current guiding wires in contact with the metal wire net or a single-sided conductive film laminated outside the metal wire net is utilized to achieve the effect of timely and effectively conducting a leakage current to a leakage current detection device, so as to improve the reliability of leakage current detection.

20 Claims, 3 Drawing Sheets

CABLE WITH CURRENT LEAKAGE DETECTION FUNCTION

CROSS-REFERENCE TO RELATED PATENT APPLICATION

This application claims priority to and the benefit of China Patent Applications No. 200910170347.x, filed Sep. 11, 2009 and No. 200910170348.4, filed Sep. 11, 2009, the contents of which are incorporated herein in their entireties by reference.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference were individually incorporated by reference.

FIELD OF THE INVENTION

The present invention relates to a wire for electric conduction, and more particularly to a cable having a current leakage detection feature.

BACKGROUND OF THE INVENTION

An alternating current (AC) cable usually has three current-carrying core wires respectively connected to a live line, a neutral line, and a ground line of a power supply. The current-carrying core wires are respectively wrapped by an insulating layer, so that any one of the current-carrying core wires is electrically insulated from the others. In addition, the AC cable has an insulating shell for surrounding the current-carrying core wires.

After the conventional AC cable has been used for a long time, a leakage current may occur between the current-carrying core wires due to aging or damage of the insulating films or other factors. The leakage current may cause fire hazard or threaten the personal safety, which should be avoided as much as possible. The prior art provides the following solutions to detect the leakage current leaking from the current-carrying core wires out of the insulating films.

In the prior art, the most direct solution is to employ a current leakage detection metal net, of which the coverage rate is greater than or equal to 85%. However, due to the high coverage rate of the current leakage detection metal net, the prior art employing the current leakage detection metal net is associated with high cost. It is noted that, the prior art of high cost cannot be solved by reducing the coverage rate of the current leakage detection metal net because lower coverage rate may result in poor leakage current detection effects.

Chinese Patent Application No. CN200520063686.5, entitled "SCREENED CABLE", discloses a kind of screened cable, as shown in FIG. 1, which includes three current-carrying core wires A, three insulating films B, two screen nets D, and an outer insulating sheath E. The current-carrying core wires A are respectively connected to a live line, a neutral line, and a ground line of a power supply, and are electrically insulated from one another through the insulating films B. The screened cable is characterized in that: a shielding thin film C is disposed between the insulating layer B and the screen net D on each of the current-carrying core wires A connected to the live line and the neutral line. The current-carrying core wire A, the insulating layer B, the shielding thin film C, the screen net D, and the outer insulating sheath E are arranged sequentially from inside to outside.

Chinese Patent Application No. CN200720173349.0, entitled "POWER SUPPLY LINE WITH ELECTRIC LEAKAGE TESTING CONDUCTOR", discloses a power supply line with an electric leakage testing conductor feature. The power supply line includes three current-carrying core wires and one electric leakage testing conductor for detecting a current leakage phenomenon. Each current-carrying core wire is wrapped by an insulating layer on an outer surface thereof. Two current-carrying core wires are selected from the current-carrying core wires, and the insulating layer of each selected current-carrying core wire is further wrapped by a metal conductive layer. The electric leakage testing conductor for detecting the current leakage phenomenon is electrically connected to the metal conductive layers. The power supply line has an outermost insulating layer for wrapping the two selected current-carrying core wires and the electric leakage testing conductor.

Chinese Patent Application No. CN200720149261.5, entitled "POWER CABLE HAVING METAL FOIL FOR DETECTING LEAKAGE CURRENT", discloses a power cable having a metal foil which is used for detecting a leakage current. The power cable is formed by two current-carrying core wires, two insulating films respectively wrapping the two current-carrying core wires, and an outermost insulating layer wrapping the current-carrying core wires and the insulating films. The power cable is characterized in that: the outer surfaces of the insulating films of the two current-carrying core wires are respectively wrapped by a metal foil for detecting leakage current, and the outer surfaces of the metal foils are respectively covered with a sparse metal woven net, of which the coverage rate is 2%. That is, firstly, the thin metal foils wrap the outer surfaces of the insulating films of the two current-carrying core wires, and then the sparse metal woven nets wrap the metal foils, so as to reduce the cost of the power cable.

By using the thin foils to save material cost, it is associated with problems, like being brittle of fragile. Furthermore, in most cases, such thin metal foils can only be spread in a plane, but not suitable for being coiled. Therefore, under the current technical level, it is quite difficult to wrap a single layer of the thin metal foil on the surface of the insulating layer for current-carrying core wire. Even if the single layer of the thin metal foil is wrapped on the surface of the insulating layer of the current-carrying core wire at an extremely high technical cost, the metal foil is still easily broken due to the bending or folding of the current-carrying core wire during the use of the power cable. Apparently, the problem can be solved by using the thick metal foils. However, this method of having thicker metal foils does not meet the intention of cost-saving, and further increases the weight of the power cable.

Therefore, a heretofore unaddressed need exists in the art to address the aforementioned deficiencies and inadequacies.

SUMMARY OF THE INVENTION

The present invention is directed to cables that satisfies this need. A cable having features of the present invention comprises three current-carrying core wires, three insulating films, a first current leakage detection layer, and an insulating shell. The insulating films respectively wrap surfaces of the current-carrying core wires. The first current leakage detection layer wraps a surface of one of the insulating films. The first current leakage detection layer comprises a metal wire net, a dielectric insulating layer, and a thin film conductive layer laminated on the metal wire net. The thin film conductive layer is located between the metal wire net and the dielectric insulating layer. The insulating layer wrapped by the first current leakage detection layer contacts the metal wire net and thin film conductive layer respectively. The insulating shell wraps the current-carrying core wires, the insulating films, and the first current leakage detection layer.

In one embodiment, the cable may further comprise a second current leakage detection layer. The second current leakage detection layer wraps a surface of one of the insulating films not wrapped by the first current leakage detection layer. The current-carrying core wires wrapped by the first current leakage detection layer and the second current leakage detection layer are respectively used for connecting to a live line and a neutral line of a power supply.

In another one embodiment, the dielectric insulating layer is, for example, a polyester thin film or an insulating paper.

In another one embodiment, a material of the thin film conductive layer is, for example, a non-metal conductor or a metal conductor. Preferably, the material of the thin film conductive layer is copper, aluminum, or tin, and the thin film conductive layer is attached to the dielectric insulating layer by means of vacuum sputtering. Alternatively, the material of the thin film conductive layer may be graphite or carbon ink, and the thin film conductive layer is attached to the dielectric insulating layer by means of spray coating or printing.

In another one embodiment, a coverage rate of the metal wire net is, for example, greater than 10%.

In another one embodiment, a material of the metal wire net is, for example, copper, aluminum, or iron.

In another one embodiment, the cable may further comprise an insulating filler. The insulating filler is filled between the first current leakage detection layer, the second current leakage detection layer, the insulating layer not wrapped by the first current leakage detection layer or the second current leakage detection layer, and the insulating shell.

Another cable having features of the present invention comprises three current-carrying core wires, three insulating films, a first current leakage detection layer, and an insulating shell. The insulating films respectively wrap surfaces of the current-carrying core wires. The first current leakage detection layer wraps a surface of one of the insulating films. The first current leakage detection layer comprises a metal wire net and current guiding wires. The metal wire net contacts the current guiding wires. The insulating shell wraps the current-carrying core wires, the insulating films, and the first current leakage detection layer.

In another one embodiment, the cable may further comprise a second current leakage detection layer. The second current leakage detection layer wraps a surface of one of the insulating films not wrapped by the first current leakage detection layer. The current-carrying core wires wrapped by the first current leakage detection layer and the second current leakage detection layer are respectively used for connecting to a live line and a neutral line of a power supply.

In another one embodiment, a coverage rate of the metal wire net is, for example, greater than 20%.

In another one embodiment, a diameter of the current guiding wires is, for example, larger than that of metal wires of the metal wire net. Preferably, the diameter of the current guiding wires is 1.5 to 2.5 times of that of the metal wires of the metal wire net.

In another one embodiment, the number of the current guiding wires is, for example, 5 to 10.

In another one embodiment, a material of the metal wire net is, for example, copper, aluminum, or iron.

In another one embodiment, a material of the current guiding wires is, for example, copper, aluminum, or iron.

In another one embodiment, the cable may further comprise an insulating filler. The insulating filler is filled between the first current leakage detection layer, the second current leakage detection layer, the insulating layer not wrapped by the first current leakage detection layer or the second current leakage detection layer, and the insulating shell.

Based on the above, as compared with the prior art, the above structure having the metal wire net disposed at an inner side of a single-sided conductive film, that is, the metal wire net is located between the insulating layer and the single-sided conductive film, has the following advantages.

Firstly, since the dielectric insulating layer in the above embodiments has a desirable toughness, the dielectric insulating layer can provide support for the thin film conductive layer, and thus the thin film conductive layer can be thinner than the metal foil in the prior art.

Secondly, since the single-sided conductive film in the above embodiments is a composite structure formed by laminating the thin film conductive layer and the dielectric insulating layer, the single-sided conductive film in the above embodiments has a higher structural strength as compared with the prior art merely using a single layer of metal foil, so as to prevent the thin film conductive layer from being broken and improve the operational reliability.

Thirdly, since the thin film conductive layer is disposed outside the metal wire net, leakage current detection is performed with a larger area of the insulating layer being inspected and thus achieve a higher detection precision as compared with the prior art. Furthermore, the dielectric insulating layer is located at the outermost side of the entire current leakage detection layer, that is, the dielectric insulating layer wraps the current-carrying core wire, the insulating layer, the metal wire net, and the thin film conductive layer. Thus, as compared with the prior art, when a leakage current leaks out of the insulating layer from the current-carrying core wire, the dielectric insulating layer can provide a second barrier layer to prevent the leakage current from leaking out of the dielectric insulating layer.

In addition, the difference between the above embodiments having the metal wire net disposed at the inner side of the single-sided conductive film and Chinese Utility Model Patent Application No. CN200520063686.5 is that: in CN200520063686.5, the shielding thin film C is disposed inside the screen net D, whereas the metal wire net is disposed at an inner side of the single-sided conductive film in the above embodiments. In other words, the shielding thin film C is located between the insulating layer B and the screen net D in CN200520063686.5, whereas the metal wire net in the above embodiments is located between the insulating layer and the single-sided conductive film. Therefore, as compared with the CN200520063686.5, the dielectric insulating layer is located at the outermost side of the entire current leakage detection layers, and such a structure with the metal wire net disposed at the inner side of the single-sided conductive film overcomes the problem of difficult leakage current detection caused by disposing the shielding thin film C inside the screen net D in the CN200520063686.5.

As compared with the prior art, the above structure having current guiding wires contacted with the metal wire net has the following advantages.

Firstly, the implementation of taking the metal wire net having a medium coverage rate as a medium for leakage current detection not only achieves the purpose of detecting a leakage current, but also has advantages of saving the material cost and reducing the weight and cost of the cable.

Secondly, the leakage current can be reliably transferred to a leakage current detection device through the current guiding wires. The leakage current detection device is, for example, a leakage current detection switch.

Thirdly, the prior art merely uses the metal wire net to conduct a leakage current, and once the metal wire net is broken, the leakage current cannot be transferred smoothly. On the contrary, the structure having current guiding wires contacted with the metal wire net can adopt current guiding wires made of metal wires thicker than metal wires of the metal wire net. Thus, as compared with the prior art, when the metal wire net is broken, the current guiding wires can still provide a smooth conduction path for the leakage current. In addition, a resistance of the current guiding wires is smaller than that of the metal wires of the metal wire net, so that the structure having current guiding wires contacted with the metal wire net can improve the detection precision of the leakage current when the leakage current enters the metal wire net. Furthermore, the diameter of the current guiding wires is larger than that of the metal wires of the metal wire net, so that the current guiding wires may be used as a frame to increase the structural strength of the metal wire net.

The above cables having the current leakage detection layers can rapidly and precisely detect whether a desirable insulation effect is maintained between the current-carrying core wires, so that the cables in the above embodiments is applicable to various household appliances and especially suitable for appliances having large power consumption such as air conditioners or water heaters.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
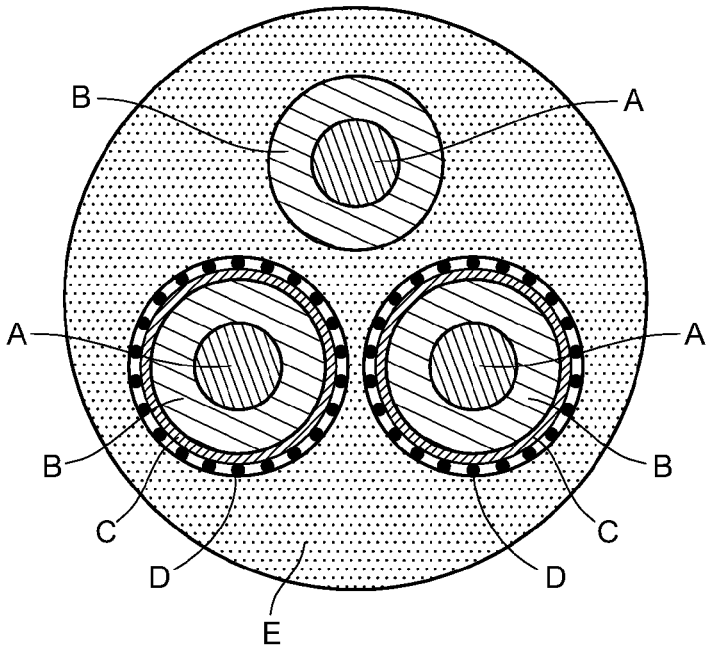
FIG.1 (Prior Art)
FIG. 1 shows a schematic cross-sectional view of a screened cable in the prior art.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 2-5. In accordance with the purposes of this invention, as embodied and broadly described herein, this invention, in one aspect, relates to a cable having a current leakage detection feature.

Figure 2:
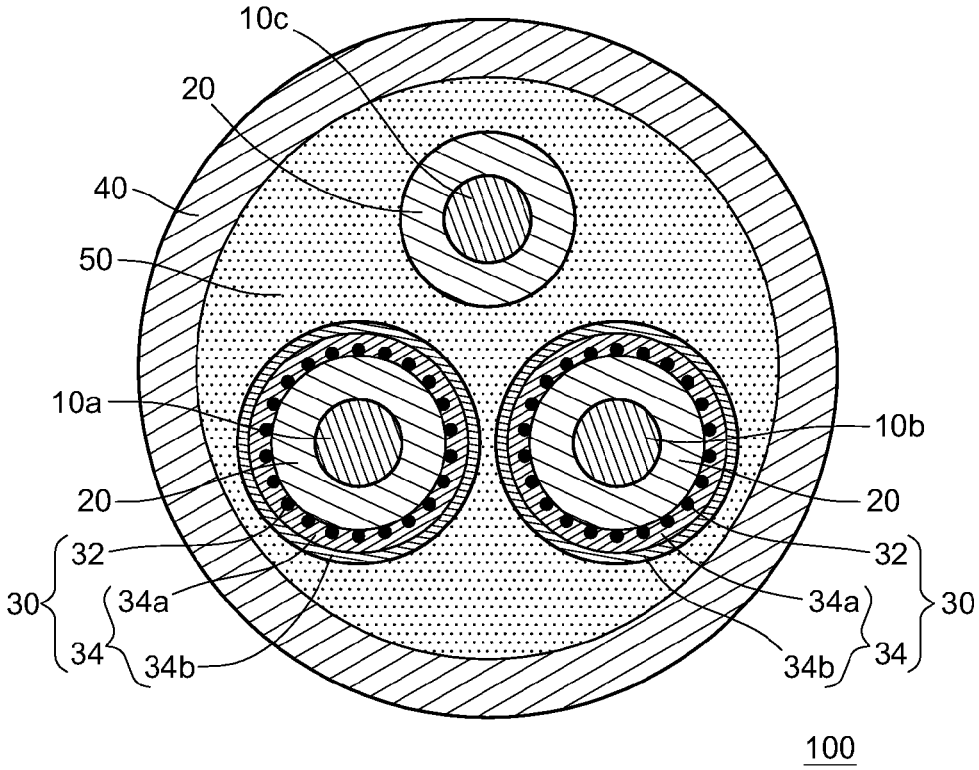
FIG. 2 shows a schematic cross-sectional view of a cable having a current leakage detection function according to an embodiment of the present invention.

FIG. 2 is a schematic cross-sectional view of a cable having a current leakage detection function according to an embodiment of the present invention. A cable 100 is suitable for connecting to a power supply comprising a live line, a neutral line, and a ground line. The cable 100 comprises a current-carrying core wire 10*a* for being connected to the live line, a current-carrying core wire 10*b* for being connected to the neutral line, and a current-carrying core wire 10*c* for being connected to the ground line. The surface of each of the current-carrying core wires 10*a*, 10*b*, and 10*c* is wrapped by an insulating film 20, so that the current-carrying core wires 10*a*, 10*b*, and 10*c* are electrically insulated from one another. In order to perform the current leakage detection, the insulating film 20 of at least one of the current-carrying core wires 10*a*, 10*b*, and 10*c* is wrapped by a current leakage detection layer 30. In the embodiment illustrated in the FIG. 2, the current-carrying core wires 10*a* and 10*b* are respectively connected to the live line and the neutral line of the power supply, so that the insulating film 20 wrapping the current-carrying core wire 10*a* and the insulating film 20 wrapping the current-carrying core wire 10*b* require the leakage current detection. Accordingly, the insulating films 20 on the current-carrying core wires 10*a* and 10*b* are respectively wrapped by the current leakage detection layers 30, whereas the insulating film 20 on the current-carrying core wire 10*c* connected to the ground line G is not wrapped by any current leakage detection layer 30. Certainly, in another embodiment of the present invention, the insulating film 20 on the current-carrying core wire 10*c* connected to the ground line G may also be wrapped by another current leakage detection layer 30, which, however, may increase the cost of the cable 100. In this embodiment, the current leakage detection layer 30 comprises a metal wire net 32 and a single-sided conductive film 34 laminated outside the metal wire net 32. The single-sided conductive film 34 comprises a thin film conductive layer 34*a* and a dielectric insulating layer 34*b*. The insulating film 20 is in close contact with the thin film conductive layer 34*a* and the metal wire net 32 respectively.

The cable 100 further comprises an insulating shell 40. The insulating shell 40 wraps the current-carrying core wires 10*a*, 10*b*, and 10*c*, the insulating films 20, and the current leakage detection layers 30.

Furthermore, in order to increase the structural strength of the cable 100 and maintain the structural integrity of the cable 100, a non-conductive filler 50 may be filled between the current leakage detection layers 30, the insulating film 20 wrapping the current-carrying core wire 10*c*, and the insulating shell 40. For example, the filler 50 is cotton threads.

The above current-carrying core wires 10*a*, 10*b*, and 10*c*, insulating films 20, insulating shell 40, and filler 50 may all employ existing materials or products. The structure of the current leakage detection layer 30 is introduced below in detail.

In this embodiment, the metal wire nets 32 wrap the surfaces of the insulating films 20 of the current-carrying core wires 10*a* and 10*b* respectively, so as to receive a leakage current leaking out of the insulating films 20 from the current-carrying core wires 10*a* and 10*b*, and guide the leakage current to a detection unit respectively. In this embodiment, a coverage rate of the metal wire net 32 is greater than or equal to 5%. Moreover, in order to achieve a balance among the leakage current detection effect, the weight of the cable 100, and the fabrication cost of the cable 100, the coverage rate of the metal wire net 32 is preferably between 5% and 50%. A material of the metal wire net 32 may be metal. For example, the metal wire net 32 is made of copper wires, aluminum wires, or iron wires. The metal wire net 32 may be fabricated by means of printing. However, the metal wire net 32 fabricated by means of printing has poor flexibility and is easily broken at cross points of net wires, so that the metal wire net 32 is preferably fabricated by means of weaving.

The contacting relation between the insulating films 20 on the current-carrying core wire 10*a* connected to the live line and the metal wire nets 32 and the contacting relation between the current-carrying core wire 10*b* connected to the neutral line and the metal wire nets 32 are quite important. Besides, in this embodiment, the metal wire net 32 is wrapped by the single-sided conductive film 34, so that the metal wire net 32 is laminated between the single-sided conductive film 34 and the insulating film 20. The single-sided conductive film 34 has the thin film conductive layer 34*a* on its inner side and the dielectric insulating layer 34*b* on its outer side. In other words, the thin film conductive layer 34*a* is located between the dielectric insulating layer 34*b* and the metal wire net 32. In addition, on the current-carrying core wires 10*a* and 10*b*, the thin film conductive layers 34*a* are in close contact with the metal wire nets 32 and contact the insulating films 20 at meshes of the metal wire nets 32. Such a structure of the current leakage detection layer 30 can improve the leakage current detection effect. More particularly, when the leakage current flows out of the insulating film 20 from the current-carrying core wire 10*a* or 10*b*, and the thin film conductive layer 34*a* detects the leakage current, the leakage current that flows out of the insulating film 20 may be conducted to the metal wire net 32 through the thin film conductive layer 34*a*. Afterwards, the metal wire net 32 conducts the leakage current to a specific leakage current detection unit. Since any position on the surface of the insulating film 20 contacts either the metal wire net 32 or the thin film conductive layer 34*a*, the leakage current detection can be timely and effectively performed on the insulating film 20 on the current-carrying core wire 10*a* or 10*b* in this embodiment, and the leakage current can be rapidly guided to the leakage current detection unit.

A material of the thin film conductive layer 34*a* may be a conductive non-metal material. For example, the thin film conductive layer 34*a* is formed by a conductive structure of graphite, carbon ink, or other carbon allotropes. Besides, the material of the thin film conductive layer 34*a* may also be a metal conductor. For example, the thin film conductive layer 34*a* is made of copper, aluminum, or tin. A material of the dielectric insulating layer 34*b* may be a non-conductive high-molecular polymer. For example, the dielectric insulating layer 34*b* is made of polyester, polyamide, or an insulating paper.

Preferably, the single-sided conductive film 34 is fabricated, for example, by taking the dielectric insulating layer 34*b* as the basis and forming a metal layer on the dielectric insulating layer 34*b* through vacuum sputtering, in which the formed metal layer is the thin film conductive layer 34*a*. The dielectric insulating layer 34*b* is, for example, a polyester thin film or an insulating paper, and the metal formed on the dielectric insulating layer 34*b* is, for example, copper, aluminum, or tin. Furthermore, in another embodiment of the present invention, the single-sided conductive film 34 may also be fabricated by forming a conductive non-metal material layer on the dielectric insulating layer 34*b* through spray coating or printing, in which the formed conductive non-metal material layer is the thin film conductive layer 34*a*. The dielectric insulating layer 34*b* is, for example, a polyester thin film or an insulating paper, and the non-metal material layer is, for example, a graphite layer or a carbon ink layer.

Figure 3:
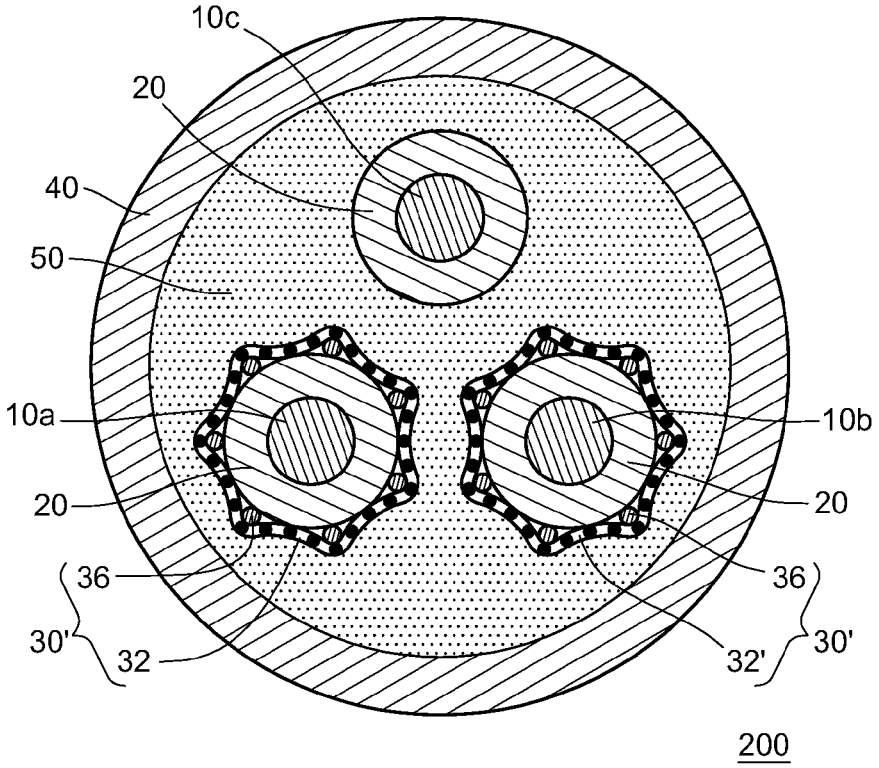
FIG. 3 shows a schematic view of a cable having a current leakage detection function according to another embodiment of the present invention.

FIG. 3 is a schematic view of a cable having a current leakage detection function according to another embodiment of the present invention. A cable 200 is suitable for connecting to a power supply comprising a live line, a neutral line, and a ground line. The cable 200 comprises a current-carrying core wire 10*a* for being connected to the live line, a current-carrying core wire 10*b* for being connected to the neutral line, and a current-carrying core wire 10*c* for being connected to the ground line. The surface of each of the current-carrying core wires 10*a*, 10*b*, and 10*c* is wrapped by an insulating film 20, so that the current-carrying core wires 10*a*, 10*b*, and 10*c* are electrically insulated from one another. In order to perform the current leakage detection, the insulating film 20 of at least one of the current-carrying core wires 10*a*, 10*b*, and 10*c* is wrapped by a current leakage detection layer 30'. In the embodiment illustrated the FIG. 3, the current-carrying core wires 10*a* and 10*b* are respectively connected to the live line and the neutral line of the power supply, so that the insulating film 20 wrapping the current-carrying core wire 10*a* and the insulating film 20 wrapping the current-carrying core wire 10*b* require the current detection. Accordingly, the insulating films 20 on the current-carrying core wires 10*a* and 10*b* are respectively wrapped by the current leakage detection layers 30', whereas the insulating film 20 on the current-carrying core wire 10*c* connected to the ground line G is not wrapped by any current leakage detection layer 30'. Certainly, in another embodiment of the present invention, the insulating film 20 on the current-carrying core wire 10*c* connected to the ground line G may further be wrapped by another current leakage detection layer 30', which, however, may increase the cost of the cable 200. In this embodiment, the current leakage detection layer 30' comprises a metal wire net 32' and current guiding wires 36 laminated on the metal wire net 32'. The metal wire net 32' is in close contact with the current guiding wires 36.

The cable 200 further comprises an insulating shell 40. The insulating shell 40 wraps the current-carrying core wires 10*a*, 10*b*, and 10*c*, the insulating films 20, and the current leakage detection layers 30'.

Furthermore, in order to increase the structural strength of the cable 200 and maintain the structural integrity of the cable 200, a non-conductive filler 50 may be further filled between the current leakage detection layers 30', the insulating film 20 wrapping the current-carrying core wire 10*c*, and the insulating shell 40. For example, the filler 50 is cotton threads.

The above current-carrying core wires 10*a*, 10*b*, and 10*c*, insulating films 20, insulating shell 40, and filler 50 may all employ existing materials or products. The structure of the current leakage detection layer 30' is introduced below in detail.

Figure 4:
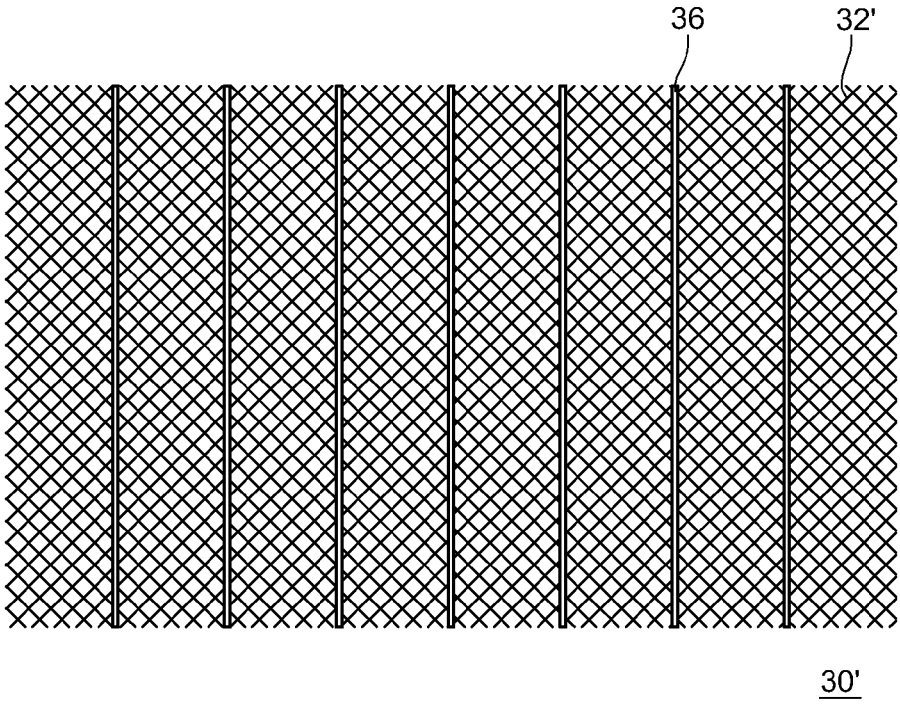
FIG. 4 shows a schematic unfolded view of a current leakage detection layer in FIG. 3.

FIG. 4 is a schematic unfolded view of the current leakage detection layer 30' in FIG. 3. Referring to FIGS. 3 and 4, the current leakage detection layer 30' comprises a metal wire net 32' and current guiding wires 36 in close contact with the metal wire net 32'. The insulating films 20 on the current-carrying core wires 10*a* and 10*b* are in close contact with the metal wire nets 32' and the current guiding wires 36, so as to detect a leakage current leaking out of the insulating film 20 from the current-carrying core wire 10*a* or 10*b*. In this embodiment, a coverage rate of the metal wire net 32' is more than 10%. Furthermore, in order to achieve a balance among the leakage current detection effect, the weight of the cable 200, and the fabrication cost of the cable 200, the coverage rate of the metal wire net 32' is preferably between 10% and 50%. For the sake of saving the cost, thin wires are used in the metal wire net 32', so that net wires of such metal wire net 32' are easily broken. Therefore, in order to prevent the net wires of the metal wire net 32' from being broken and hampering the conduction of the leakage current on the metal wire net 32', a diameter of the current guiding wires 36 in this embodiment is, for example, larger than that of the metal wires of the metal wire net 32'. In the schematic unfolded view of the current leakage detection layer 30' in FIG. 4, the current guiding wires 36 are parallel to each other. Therefore, when the current leakage detection layer 30' is wound on the surface of the insulating film 20, the current guiding wires 36 are arranged as straight lines parallel to each other or helical lines equidistantly spaced apart from each other. It should be noted that, the above arrangement of the current guiding wires 36 is not intended to limit the present invention. In another embodiment of the present invention, the current guiding wires 36 may also be arranged on the surface of the insulating film 20 in a manner of crossing each other. Considering the difference between the above arrangements, the current guiding wires 36 arranged crossing each other have a larger length, so that the crossing arrangement may increase an area on the metal wire net 32' covered by the current guiding wires 36, whereas the current guiding wires 36 arranged parallel to each other can be processed conveniently, so that the parallel arrangement has the advantage of a low fabrication cost.

Preferably, the number of the current guiding wires 36 is 5 to 10, and the diameter of the current guiding wires 36 is 1.5 to 3 times of that of the metal wires of the metal wire net 32'. More preferably, the diameter of the current guiding wires 36 is 1.5 to 2.5 times of that of the metal wires of the metal wire net 32'. For example, in the embodiment shown in FIG. 4, 7 current guiding wires 36 and the metal wire net 32' having the coverage rate of 30% are employed, and the diameter of the current guiding wires 36 is 1.5 times of that of the metal wires of the metal wire net 32'.

The current guiding wires 36 may be copper wires, aluminum wires, iron wires, or other common metal wires. Similarly, the metal wires of the metal wire net 32' may also be copper wires, aluminum wires, iron wires, or other metal wires. The metal wire net 32' may be fabricated by means of printing. However, the metal wire net 32' fabricated by means of printing has poor flexibility and is easily broken at cross points of net wires, so that the metal wire net 32' is preferably fabricated by means of weaving.

Figure 5:
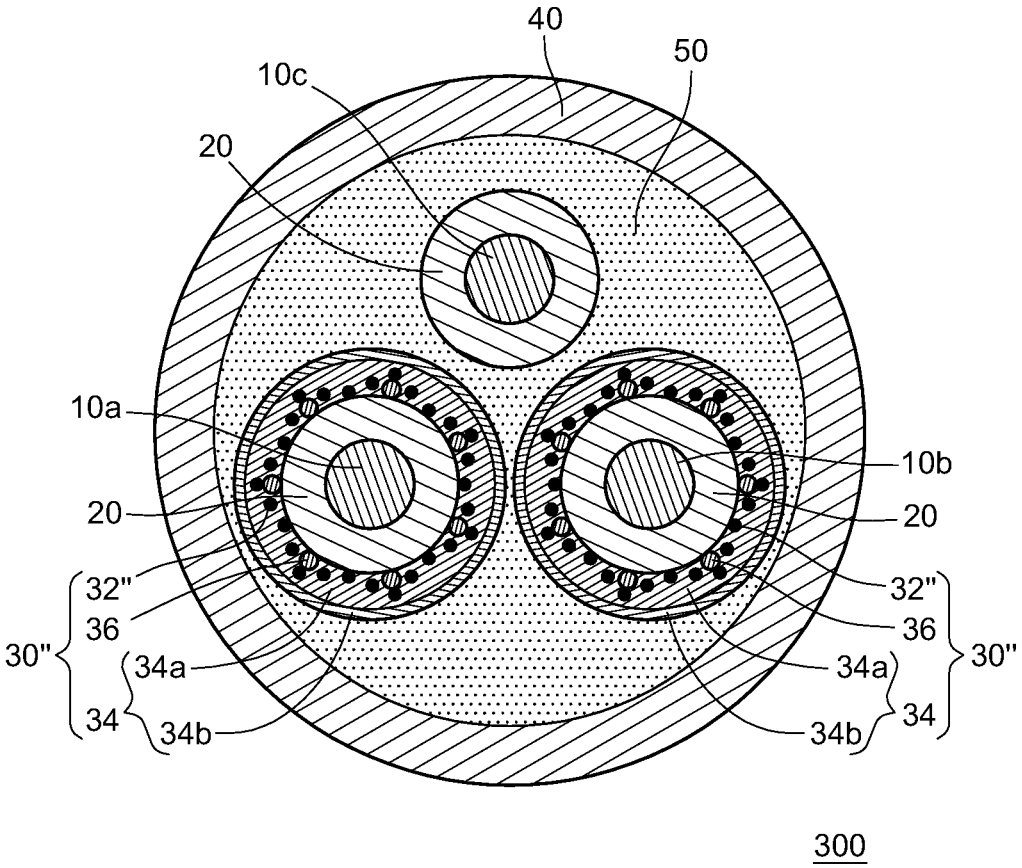
FIG. 5 shows a schematic view of a cable having a current leakage detection function according to yet another embodiment of the present invention.

FIG. 5 is a schematic view of a cable having a current leakage detection function according to yet another embodiment of the present invention. A cable 300 is suitable for connecting to a power supply comprising a live line, a neutral line, and a ground line. The cable 300 comprises a current-carrying core wire 10*a* for being connected to the live line, a current-carrying core wire 10*b* for being connected to the neutral line, and a current-carrying core wire 10*c* for being connected to the ground line. The surface of each of the current-carrying core wires 10*a*, 10*b*, and 10*c* is wrapped by an insulating film 20, so that the current-carrying core wires 10*a*, 10*b*, and 10*c* are electrically insulated from one another. In order to perform the current leakage detection, the insulating film 20 of at least one of the current-carrying core wires 10*a*, 10*b*, and 10*c* is wrapped by a current leakage detection layer 30". In the embodiment illustrated in the FIG. 5, the current-carrying core wires 10*a* and 10*b* are respectively connected to the live line and the neutral line of the power supply, so that the insulating film 20 wrapping the current-carrying core wire 10*a* and the insulating film 20 wrapping the current-carrying core wire 10*b* require the current detection most. Accordingly, the insulating films 20 on the current-carrying core wires 10*a* and 10*b* are respectively wrapped by the current leakage detection layers 30", whereas the insulating film 20 on the current-carrying core wire 10*c* connected to the ground line G is not wrapped by any current leakage detection layer 30". Certainly, in another embodiment of the present invention, the insulating film 20 on the current-carrying core wire 10*c* connected to the ground line G may also be wrapped by another current leakage detection layer 30", which, however, may increase the cost of the cable 300. In this embodiment, the current leakage detection layer 30" comprises a metal wire net 32", current guiding wires 36, and a single-sided conductive film 34. The metal wire net 32" contacts the current guiding wires 36, and the insulating film 20 contacts a thin film conductive layer 34*a* and the metal wire net 32" respectively.

The cable 300 further comprises an insulating shell 40. The insulating shell 40 wraps the current-carrying core wires 10*a*, 10*b*, and 10*c*, the insulating films 20, and the current leakage detection layers 30".

Furthermore, in order to increase the structural strength of the cable 300 and maintain the structural integrity of the cable 300, a non-conductive filler 50 may be further filled between the current leakage detection layers 30", the insulating film 20 wrapping the current-carrying core wire 10*c*, and the insulating shell 40. For example, the filler 50 is cotton threads.

The above current-carrying core wires 10*a*, 10*b*, and 10*c*, insulating films 20, insulating shell 40, and filler 50 may all employ existing materials or products. The structure of the current leakage detection layer 30" is introduced below in detail.

In this embodiment, the metal wire nets 32" respectively wrap the insulating films 20 on the current-carrying core wires 10*a* and 10*b* and the current guiding wires 36 are in close contact with the metal wire nets 32", so as to detect a leakage current leaking out of the insulating film 20 from the current-carrying core wire 10*a* or 10*b*, and guide the leakage current to a detection unit. For the sake of saving the cost, thin wires are used as metal wires of the metal wire net 32", so that net wires of such metal wire net 32" are easily broken. Therefore, in order to prevent the net wires of the metal wire net 32" from being broken and hampering the conduction of the leakage current, a diameter of the current guiding wires 36 in this embodiment is, for example, larger than that of the metal wires of the metal wire net 32". When the current leakage detection layer 30" is wound on the surface of the insulating film 20, the current guiding wires 36 are arranged as straight lines parallel to each other or helical lines equidistantly spaced apart from each other. It should be noted that, the above arrangement of the current guiding wires 36 when the current leakage detection layer 30" is wound on the surface of the insulating film 20 is not intended to limit the present invention. In another embodiment of the present invention, the current guiding wires 36 may also be arranged on the surface of the insulating film 20 in a manner of crossing each other. Considering the difference between the above arrangements, the current guiding wires 36 arranged crossing each other have a larger length, so that the crossing arrangement may increase an area on the metal wire net 32" covered by the current guiding wires 36, whereas the current guiding wires 36 arranged parallel to each other can be processed conveniently, so that the parallel arrangement has the advantage of a low fabrication cost.

The current guiding wires 36 may be copper wires, aluminum wires, iron wires, or other common metal wires. A material of the metal wire net 32" may be metal wires. For example, the metal wire net 32" is made of wires, aluminum wires, or iron wires. The metal wire net 32" may be fabricated by means of printing. However, the metal wire net 32" fabricated by means of printing has poor flexibility and is easily broken at cross points of net wires, so that the metal wire net 32" is preferably fabricated by means of weaving.

The contact relation between the insulating films 20 on the current-carrying core wire 10*a* connected to the live line and the metal wire nets 32" and the contact relation between the insulating films 20 on the current-carrying core wire 10*b* connected to the neutral line and the metal wire nets 32" are quite important. Besides, in this embodiment, the metal wire net 32" and the current guiding wires 36 are wrapped by the single-sided conductive film 34, so that the metal wire net 32" is laminated between the single-sided conductive film 34 and the insulating film 20. The single-sided conductive film 34 has the thin film conductive layer 34*a* on its inner side and a dielectric insulating layer 34*b* on its outer side. In other words, the thin film conductive layer 34*a* is located between the dielectric insulating layer 34*b* and the metal wire net 32". In addition, on the current-carrying core wires 10*a* and 10*b*, the thin film conductive layers 34*a* are in close contact with the metal wire nets 32" and contact the insulating films 20 at meshes of the metal wire nets 32". Such a structure of the current leakage detection layer 30" can improve the leakage current detection effect. More particularly, when the leakage current flows out of the insulating film 20 from the current-carrying core wire 10*a* or 10*b*, and the thin film conductive layer 34*a* detects the leakage current, the leakage current that flows out of the insulating film 20 will be conducted to the metal wire net 32" through the thin film conductive layer 34*a*. Afterwards, the metal wire net 32" conducts the leakage current to a specific leakage current detection unit. Since any position on the surface of the insulating film 20 contacts either the metal wire net 32" or the thin film conductive layer 34*a*, the leakage current detection can be timely and effectively performed on the insulating film 20 on the current-carrying core wire 10*a* or 10*b* in this embodiment, and the leakage current can be rapidly guided to the leakage current detection unit.

A material of the thin film conductive layer 34*a* may be a conductive non-metal material. For example, the thin film conductive layer 34*a* is formed by a conductive structure of graphite, carbon ink, or other carbon allotropes. Besides, the material of the thin film conductive layer 34*a* may also be a metal conductor. For example, the thin film conductive layer 34*a* is made of copper, aluminum, or tin. A material of the dielectric insulating layer 34*b* may be a non-conductive high-molecular polymer. For example, the dielectric insulating layer 34*b* is made of polyester, polyamide, or an insulating paper.

Preferably, the single-sided conductive film 34 is fabricated, for example, by taking the dielectric insulating layer 34*b* as the basis and forming a metal layer on the dielectric insulating layer 34*b* through vacuum sputtering, in which the formed metal layer is the thin film conductive layer 34*a*. The dielectric insulating layer 34*b* is, for example, a polyester thin film or an insulating paper, and the metal formed on the dielectric insulating layer 34*b* is, for example, copper, aluminum, or tin. Furthermore, in another embodiment of the present invention, the single-sided conductive film 34 may also be fabricated by forming a conductive non-metal material layer on the dielectric insulating layer 34*b* through spray coating or printing, in which the formed conductive non-metal material layer is the thin film conductive layer 34*a*. The dielectric insulating layer 34*b* is, for example, a polyester thin film or an insulating paper, and the non-metal material layer is, for example, a graphite layer or a carbon ink layer.

Based on the above, as compared with the prior art, the above structure having the metal wire net disposed at an inner side of a single-sided conductive film, that is, the metal wire net is located between the insulating layer and the single-sided conductive film, has the following advantages.

Firstly, since the dielectric insulating layer in the above embodiments has a desirable toughness, the dielectric insulating layer can provide support for the thin film conductive layer, and thus the thin film conductive layer can be thinner than the metal foil in the prior art.

Secondly, since the single-sided conductive film in the above embodiments is a composite structure formed by laminating the thin film conductive layer and the dielectric insulating layer, the single-sided conductive film in the above embodiments has a higher structural strength as compared with the prior art merely using a single layer of metal foil, so as to prevent the thin film conductive layer from being broken and improve the operational reliability.

Thirdly, since the thin film conductive layer is disposed outside the metal wire net, leakage current detection is performed with a larger area of the insulating layer being inspected and thus achieve a higher detection precision as compared with the prior art. Furthermore, the dielectric insulating layer is located at the outermost side of the entire current leakage detection layer, that is, the dielectric insulating layer wraps the current-carrying core wire, the insulating layer, the metal wire net, and the thin film conductive layer. Thus, as compared with the prior art, when a leakage current leaks out of the insulating layer from the current-carrying core wire, the dielectric insulating layer can provide a second barrier layer to prevent the leakage current from leaking out of the dielectric insulating layer.

In addition, the difference between the above embodiments and Chinese Utility Model Patent Application No. CN200520063686.5 is that: in CN200520063686.5, the shielding thin film C is disposed inside the screen net D, whereas the metal wire net is disposed at an inner side of the single-sided conductive film in the above embodiments. In other words, the shielding thin film C is located between the insulating layer B and the screen net in CN200520063686.5, whereas the metal wire net in the above embodiments is located between the insulating layer and the single-sided conductive film. Therefore, as compared with the CN200520063686.5, the dielectric insulating layer is located at the outermost side of the entire current leakage detection layers, and such a structure with the metal wire net disposed at the inner side of the single-sided conductive film overcomes the problem about difficult leakage current detection caused by disposing the shielding thin film C inside the screen net D in the CN200520063686.5.

As compared with the prior art, the above structure having current guiding wires contacted with the metal wire net has the following advantages.

Firstly, the implementation of taking the metal wire net having a medium coverage rate as a medium for leakage current detection not only achieves the purpose of detecting a leakage current, but also has advantages of saving the material cost and reducing the weight and cost of the cable.

Secondly, the leakage current can be reliably transferred to a leakage current detection device through the current guiding wires. The leakage current detection device is, for example, a leakage current detection switch.

Thirdly, the prior art merely uses the metal wire net to conduct a leakage current, and once the metal wire net is broken, the leakage current cannot be transferred smoothly. On the contrary, the structure having current guiding wires contacted with the metal wire net can adopt current guiding wires made of thick metal wires thicker than those of the metal wire net. Thus, as compared with the prior art, when the metal wire net is broken, the current guiding wires can still provide a smooth conduction path for the leakage current. In addition, a resistance of the current guiding wires is smaller than that of the metal wires of the metal wire net, so that the structure having current guiding wires contacted with the metal wire net can improve the detection precision of the leakage current when the leakage current enters the metal wire net. Furthermore, the diameter of the current guiding wires is larger than that of the metal wires of the metal wire net, so that the current guiding wires may be used as a frame to increase the structural strength of the metal wire net.

The above cable having the current leakage detection layers can rapidly and precisely detect whether a desirable insulation effect is maintained between the current-carrying core wires, so that the cable in the above embodiments is applicable to various household appliances and especially suitable for appliances having large power consumption such as air conditioners or water heaters.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable having a current leakage detection function, comprising:

three current-carrying core wires, comprising a first current-carrying core wire connected to a live line of a power supply, a second current-carrying core wire connected to a neutral line of the power supply, and a third current-carrying core wire;

three insulating films, comprising first, second and third insulating films, wrapping the first, second and third current-carrying core wires, respectively;

a first current leakage detection layer wrapping an exterior surface of the first insulating film, and a second current leakage detection layer wrapping an exterior surface of the second insulating film, wherein each of the first current leakage detection layer and the second current leakage detection layer comprises a metal wire net and a single-sided conductive film laminated outside the metal wire net, and the single-sided conductive film comprises a dielectric insulating layer and a thin film conductive layer laminated on the metal wire net such that the thin film conductive layer is located between the metal wire net and the dielectric insulating layer, and each of the first and second insulating films wrapped by each of the first current leakage detection layer and the second current leakage detection layer is substantially in contact with the metal wire net and the thin film conductive layer, respectively, such that when a leakage current flows out of the first insulating film wrapped by the first current leakage detection layer from the first current-carrying core wire or flows out of the second insulating film wrapped by the second current leakage detection layer from the second current-carrying core wire, the leakage current flowing out is conducted to the corresponding metal wire net through the corresponding thin film conductive layer;

an insulating shell wrapping the current-carrying core wires, the insulating films, the first current leakage detection layer and the second current leakage detection layer; and an insulating filler filled between the first current leakage detection layer, the second current leakage detection layer, the third insulating film not wrapped by the first current leakage detection layer or the second current leakage detection layer, and the insulating shell, such that the insulating filler is in contact with the dielectric insulating layer of the single-sided conductive film of each of the first current leakage detection layer and the second current leakage detection layer.

2. The cable of claim 1, wherein the dielectric insulating layer is a polyester thin film or an insulating paper.

3. The cable of claim 1, wherein the thin film conductive layer is formed of a non-metal conductor or a metal conductor.

4. The cable of claim 3, wherein the thin film conductive layer is formed of copper, aluminum, or tin.

5. The cable of claim 4, wherein the thin film conductive layer is deposited to the dielectric insulating layer through vacuum sputtering.

6. The cable of claim 3, wherein the thin film conductive layer is formed of graphite or carbon ink.

7. The cable of claim 6, wherein the thin film conductive layer is deposited to the dielectric insulating layer through spray coating or printing.

8. The cable of claim 1, wherein a coverage rate of the metal wire net is greater than 5%.

9. The cable of claim 1, wherein the metal wire net is formed of copper, aluminum, or iron.

10. A cable having a current leakage detection function, comprising:

three current-carrying core wires, comprising a first current-carrying core wire connected to a live line of a power supply, a second current-carrying core wire connected to a neutral line of the power supply, and a third current-carrying core wire;

three insulating films, comprising first, second and third insulating films, wrapping the first, second and third current-carrying core wires, respectively;

a first current leakage detection layer wrapping an exterior surface of the first insulating film, and a second current leakage detection layer wrapping an exterior surface of the second insulating film, wherein each of the first current leakage detection layer and the second current leakage detection layer comprises a metal wire net and a plurality of current guiding wires substantially in contact with the metal wire net, and the metal wire net and the plurality of current guiding wires are in contact with the first and second insulating films, respectively, such that when a leakage current flows out of the first insulating film wrapped by the first current leakage detection layer from the first current-carrying core wire or flows out of the second insulating film wrapped by the second current leakage detection layer from the second current-carrying core wire, the leakage current flowing out is conducted to the corresponding metal wire net through the corresponding plurality of current guiding wires; and an insulating shell wrapping the current-carrying core wires, the insulating films, the first current leakage detection layer, and the second current leakage detection layer; and an insulating filler filled between the first current leakage detection layer, the second current leakage detection layer, the third insulating layer not wrapped by the first current leakage detection layer or the second current leakage detection layer, and the insulating shell, such that the insulating filler is in contact with the metal wire net of each of the first current leakage detection layer and the second current leakage detection layer.

11. The cable of claim 10, wherein a coverage rate of the metal wire net is greater than 10%.

12. The cable of claim 10, wherein a diameter of the current guiding wires is larger than that of metal wires of the metal wire net.

13. The cable of claim 12, wherein the diameter of the current guiding wires is 1.5 to 2.5 times of that of the metal wires of the metal wire net.

14. The cable of claim 10, wherein a number of the current guiding wires is 1 to 20.

15. The cable of claim 10, wherein the metal wire net is formed copper, aluminum, or iron.

16. The cable of claim 10, wherein the current guiding wires is formed of copper, aluminum, or iron.

17. A cable having a current leakage detection function, comprising:

three current-carrying core wires, comprising a first current-carrying core wire connected to a live line of a power supply, a second current-carrying core wire connected to a neutral line of the power supply, and a third current-carrying core wire;

three insulating films, comprising first, second and third insulating films, wrapping the first, second and third current-carrying core wires, respectively;

a first current leakage detection layer wrapping an exterior surface of the first insulating film, and a second current leakage detection layer wrapping an exterior surface of the second insulating film, wherein each of the first current leakage detection layer and the second current leakage detection layer comprises a metal wire net, a plurality of current guiding wires substantially in contact with the metal wire net, and a single-sided conductive film laminated outside the metal wire net and the plurality of current guiding wires, and the single-sided conductive film comprises a dielectric insulating layer and a thin film conductive layer laminated on the metal wire net and the plurality of current guiding wires such that the thin film conductive layer is located between the metal wire net, the plurality of current guiding wires and the dielectric insulating layer, and each of the first and second insulating films wrapped by each of the first current leakage detection layer and the second current leakage detection layer is substantially in contact with the metal wire net, the plurality of current guiding wires and the thin film conductive layer, respectively, such that when a leakage current flows out of the first insulating film wrapped by the first current leakage detection layer from the first current-carrying core wire or flows out of the second insulating film wrapped by the second current leakage detection layer from the second current-carrying core wire, the leakage current flowing out is conducted to the corresponding metal wire net through the corresponding thin film conductive layer;

an insulating shell wrapping the current-carrying core wires, the insulating films, the first current leakage detection layer and the second current leakage detection layer; and an insulating filler filled between the first current leakage detection layer, the second current leakage detection layer, the third insulating film not wrapped by the first current leakage detection layer or the second current leakage detection layer, and the insulating shell, such that the insulating filler is in contact with the dielectric insulating layer of the single-sided conductive film of each of the first current leakage detection layer and the second current leakage detection layer.

18. The cable of claim 17, wherein a coverage rate of the metal wire net is greater than 10%.

19. The cable of claim 17, wherein the diameter of the current guiding wires is 1.5 to 2.5 times of that of the metal wires of the metal wire net.

20. The cable of claim 17, wherein a number of the current guiding wires is 1 to 20.

* * * * *